US007584862B2

(12) United States Patent
Robertson

(10) Patent No.: US 7,584,862 B2
(45) Date of Patent: Sep. 8, 2009

(54) COOLER DOOR SHELF DEVICE

(75) Inventor: James David Robertson, Atlanta, GA (US)

(73) Assignee: Display Industries, LLC, Norcross, GA (US)

( * ) Notice: Subject to any disclaimer, the term of this patent is extended or adjusted under 35 U.S.C. 154(b) by 0 days.

(21) Appl. No.: 11/880,335

(22) Filed: Jul. 20, 2007

(65) Prior Publication Data

US 2008/0041803 A1 Feb. 21, 2008

Related U.S. Application Data

(62) Division of application No. 10/990,815, filed on Nov. 17, 2004, now abandoned.

(51) Int. Cl.
*A47B 73/00* (2006.01)
*A47G 29/14* (2006.01)

(52) U.S. Cl. ..... 211/75; 211/85.18

(58) Field of Classification Search ..... 211/70.1, 211/71.01, 72, 73, 74, 75, 88.01, 85.18, 85.4; D6/558, 567, 571, 574, 566, 572; 312/234.4; 40/661.03

See application file for complete search history.

(56) References Cited

U.S. PATENT DOCUMENTS 1,549,111 A * 8/1925 Grollman ..... 206/479
2,491,652 A * 12/1949 Feerick ..... 211/71.01
2,982,423 A * 5/1961 Handler et al. ..... 211/88.01
3,207,321 A * 9/1965 Joyce ..... 211/88.01
3,581,906 A * 6/1971 Joyce ..... 211/88.01
4,099,813 A * 7/1978 Olivan ..... 211/88.01
4,326,761 A * 4/1982 Schwartz ..... 312/326
4,403,700 A * 9/1983 Manlove ..... 211/88.01
4,560,072 A 12/1985 Burrell
4,984,693 A 1/1991 Belokin et al.
D316,790 S 5/1991 Robbins et al.
D323,766 S 2/1992 Robbins et al.
5,141,117 A * 8/1992 Olsen et al. ..... 211/71.01
5,330,261 A 7/1994 Bennett
5,351,841 A 10/1994 Belokin et al.
5,486,044 A * 1/1996 Bennett ..... 211/88.01
5,803,275 A * 9/1998 Schweitzer ..... 211/88.01
D400,384 S 11/1998 Belokin et al.
D409,035 S * 5/1999 Belokin et al. ..... D6/574
D410,359 S 6/1999 Belokin et al.
5,913,433 A 6/1999 Belokin et al.
D412,412 S 8/1999 Lewis
D413,036 S 8/1999 Belokin et al.
D413,473 S 9/1999 Belokin et al.
D413,474 S 9/1999 Belokin et al.

(Continued)

*Primary Examiner*—Michael Safavi
(74) *Attorney, Agent, or Firm*—John L. James

(57) ABSTRACT

A shelf device for mounting on an inside surface of a cooler door comprises a bottom panel and left and right mounting flanges connected to the bottom panel along left and right side edge portions thereof. Each flange has a pair of openings therein vertically spaced from one another and adapted to mount and support the shelf device. A partition panel is connected to the bottom panel and divides the bottom panel into a plurality of compartments. Vertically extending ribs are attached to the partition panel at junctions of adjacent compartments. A display panel is spaced from the bottom panel and attached to the ribs. The display panel includes top and bottom lips forming a slot for slidably receiving a display insert. Ventilation openings in the partition panel increase air circulation.

5 Claims, 9 Drawing Sheets

U.S. PATENT DOCUMENTS

D435,382 S * 12/2000 Sorensen et al. ..... D6/574
6,571,967 B2 6/2003 Belokin et al.
D488,017 S 4/2004 Belokin et al.
D516,359 S * 3/2006 Belokin et al. ..... D6/574
D547,992 S * 8/2007 Belokin ..... D6/574
D563,710 S * 3/2008 Belokin et al. ..... D6/574
2003/0222037 A1 12/2003 Belokin et al.
2004/0055981 A1 3/2004 Walsh et al.

* cited by examiner

COOLER DOOR SHELF DEVICE

CROSS REFERENCE TO RELATED APPLICATIONS

This application is a division of application Ser. No. 10/990,815 filed Nov. 17, 20004, now abandoned which is related to commonly assigned application Ser. Nos. 10/929,975, now abandoned filed Aug. 20, 2004 entitled "Cooler Door Shelf Device With Removable Product Panel"; 10/944,246, now U.S. Pat. No. 7,191,905, filed Sep. 16, 2004 entitled "Cooler Door Shelf Device With Stick-On Display Panels"; 10/944,295, filed Sep. 16, 2004 entitled "Cooler Door Shelf Device With Raised Panels"; 10/947,467, now U.S. Pat. No. 7,066,340, filed Sep. 22, 2004, entitled "Neck-Hanging Cooler Door Shelf Device"; and 10/947,472, now U.S. Pat. No. 7,080,744, filed Sep. 22, 2004, entitled "Vented Cooler Door Shelf Device".

TECHNICAL FIELD OF THE INVENTION

This invention relates generally to a cooler, and, more particularly, to a door shelf device for a transparent cooler door.

BACKGROUND OF THE INVENTION

Upright coolers in supermarkets and convenience stores typically have transparent glass doors so that the products inside are visible. It is now common to use the inside of the door for shelving as is done in household refrigerators. Door shelving fits against the door so that the product containers are visible, however the product labels do not always face forward for easy identification of the product. Some shelves have a small area for affixing product identification, but such small areas lack the impact needed, especially for impulse purchases. Accordingly, it will be appreciated that it would be highly desirable to have a door shelf with a large area for product labeling and identification.

A display shelf which employs a mounting or support panel for attachment to one face of a transparent wall is disclosed in U.S. Pat. No. 5,913,433. The display shelf has a floor which projects from the top edge of the support panel and a containment wall which projects upwardly from the floor. The support panel does not extend above the floor in the area which supports displayed product so that the product is visible through the transparent wall. Advertising material may be displayed on the support panel below the floor and the containment wall and/or floor may be appropriately shaped to provide individual compartments for each unit of product displayed. The display shelf is supported on a cooler door by suction cups which anchor in openings in flanges wherein one opening is above the floor and the other opening is below the floor. Advertising on the support panel cannot be changed while the shelf is attached to the cooler door because the lower openings and suction cups block access. Accordingly, it will be appreciated that it would be highly desirable to have a display shelf device that allows the advertising to be changed while the shelf device is attached to the cooler door.

Also, the support or mounting panel and floor intersect which inhibits the free circulation of air in the cooler. It is desirable to have a shelf device wherein the floor and display panel are separated and do not intersect blocking air circulation. It is also desirable to have a shelf device that promotes the free circulation of air to keep refrigerated products chilled.

SUMMARY OF THE INVENTION

The present invention is directed to overcoming one or more of the problems set forth above. Briefly summarized, according to one aspect of the present invention, a shelf device for an inside surface of a cooler door comprises a bottom panel having front, rear, left and right side edge portions. A left mounting flange is connected to the bottom panel along the left side edge portion and extends upward therefrom. The left mounting flange defines a left recess and has a pair of left keyways therein vertically spaced from one another and adapted to mount and support the shelf device. A right mounting flange is connected to the bottom panel along the right side edge portion and extending upward therefrom. The right mounting flange defines a right recess and has a pair of right keyways therein vertically spaced from one another and adapted to mount and support the shelf device. A partition panel is connected to the bottom panel and the left and right mounting flanges dividing the bottom panel into a plurality of compartments. A display panel is spaced from the bottom panel and attached to the left and right recesses and extends therebetween.

Space between the display panel and bottom panel allows the free flow of air to keep products on the shelf device chilled. The shelf device is attached to the inside surface of the cooler door using suction cups with a protrusion. The protrusions fit through the openings in the mounting flanges to anchor the shelf device to the door. The shelf device utilizes space in the cooler that would otherwise be wasted. The shelf device increases visual appeal and places product identification at the door where it is more readily seen than that on the containers in the cooler. The display panel includes top and bottom lips forming a slot for slidably receiving a display insert. Because the shelf device is supported via openings in the flanges above and below the display panel and is spaced from the door by suction cups, the insert can be inserted and removed while the shelf device is mounted on the cooler door. The recesses allow the display panel to be flush with the mounting flanges.

According to another aspect of the invention, a shelf device for mounting on an inside surface of a cooler door comprises a bottom panel having front, rear, left and right side edge portions. A left mounting flange is connected to the bottom panel along the left side edge portion and extends upward therefrom. The left mounting flange has a pair of left keyways therein vertically spaced from one another and adapted to mount and support the shelf device. A right mounting flange is connected to the bottom panel along the right side edge portion and extends upward therefrom. The right mounting flange has a pair of right keyways therein vertically spaced from one another and adapted to mount and support the shelf device. A partition panel is connected to the bottom panel and both mounting flanges dividing the bottom panel into a plurality of compartments. A plurality of vertically extending ribs are attached to the partition panel at junctions of adjacent compartments. A display panel is spaced from the bottom panel and attached to the ribs and extends laterally between the flanges.

Each rib contains a slot for receiving the display panel allowing the ribs to extend to the front side edge of the bottom panel. Where structural members are thin, the display panel has end portions lapping onto the left and right flanges to increase structural integrity. Lapping the display panel also creates spacing between the door and flanges so that the display can always be inserted and removed while the shelf device is mounted on the door.

According to yet another aspect of the invention, a shelf device for an inside surface of a cooler door comprises a bottom panel having front, rear, left and right side edge portions. A left mounting flange is connected to the bottom panel along the left side edge portion and extends upward therefrom. The left mounting flange has a pair of left keyways therein vertically spaced from one another and adapted to mount and support the shelf device. The left flange defines a left recess. A right mounting flange is connected to the bottom panel along the right side edge portion and extends upward therefrom. The right mounting flange has a pair of right keyways therein vertically spaced from one another and adapted to mount and support the shelf device. The right flange defines a right recess. A partition panel is connected to the bottom panel, left and right mounting flanges dividing the bottom panel into a plurality of compartments. A plurality of vertical ribs is attached to the partition panel at junctions of adjacent compartments with each rib defining a slot. A plurality of display panels is spaced from the bottom panel. Each display panel is associated with a selected one of the ribs and positioned in the recess of the associated rib.

The slots and recesses allow the display panel to fit flush with the mounting flanges. Positioning the display panel above the bottom panel creates a space for improved air circulation. Ventilation openings also promote increased air flow. Having a plurality of display panel supporting the display conserves material when compared to a single, lengthy display panel.

These and other aspects, objects, features and advantages of the present invention will be more clearly understood and appreciated from a review of the following detailed description of the preferred embodiments and appended claims, and by reference to the accompanying drawings wherein similar reference numerals have been used, where possible, to designate similar or identical features that are common to the figures.

DETAILED DESCRIPTION OF THE PREFERRED EMBODIMENTS

Figure 1:
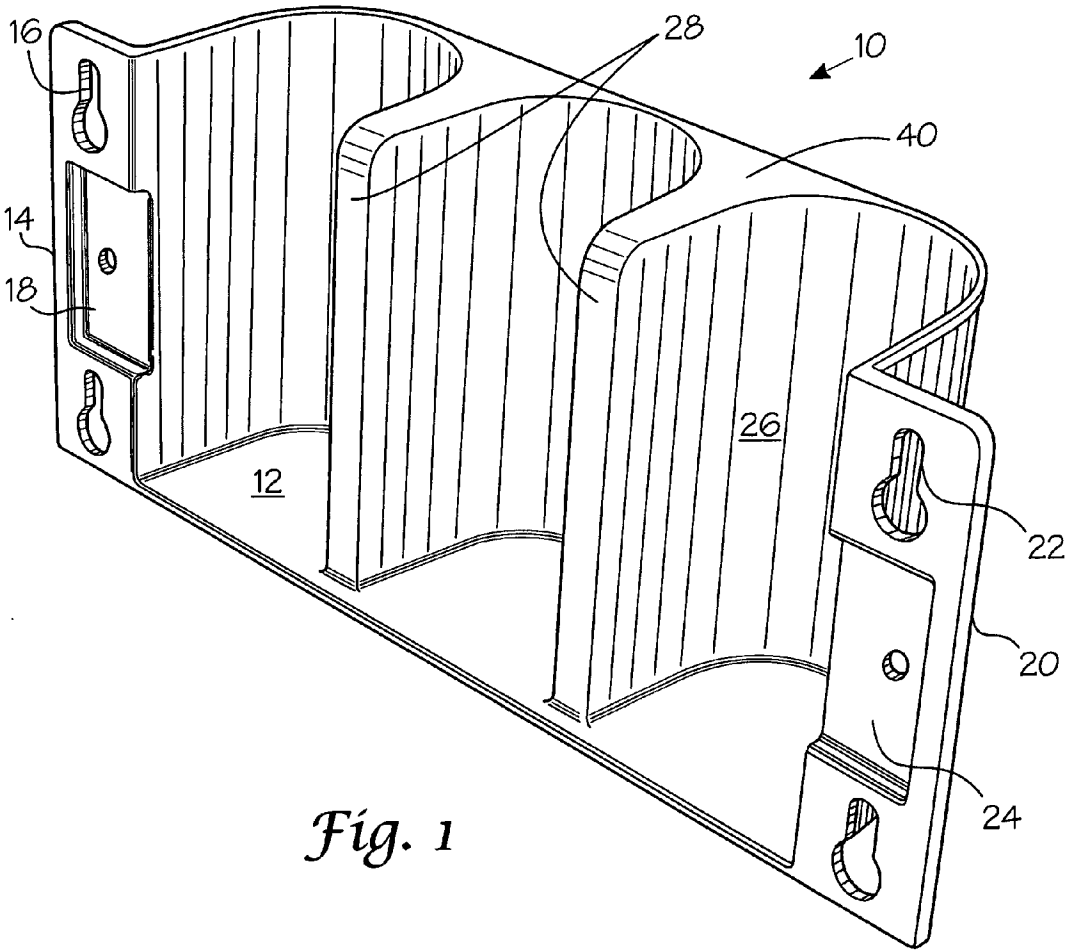
FIG. 1 is a front perspective view of a preferred embodiment of a shelf device for attaching to the inside surface of an upright cooler door according to the present invention.
Figure 2:
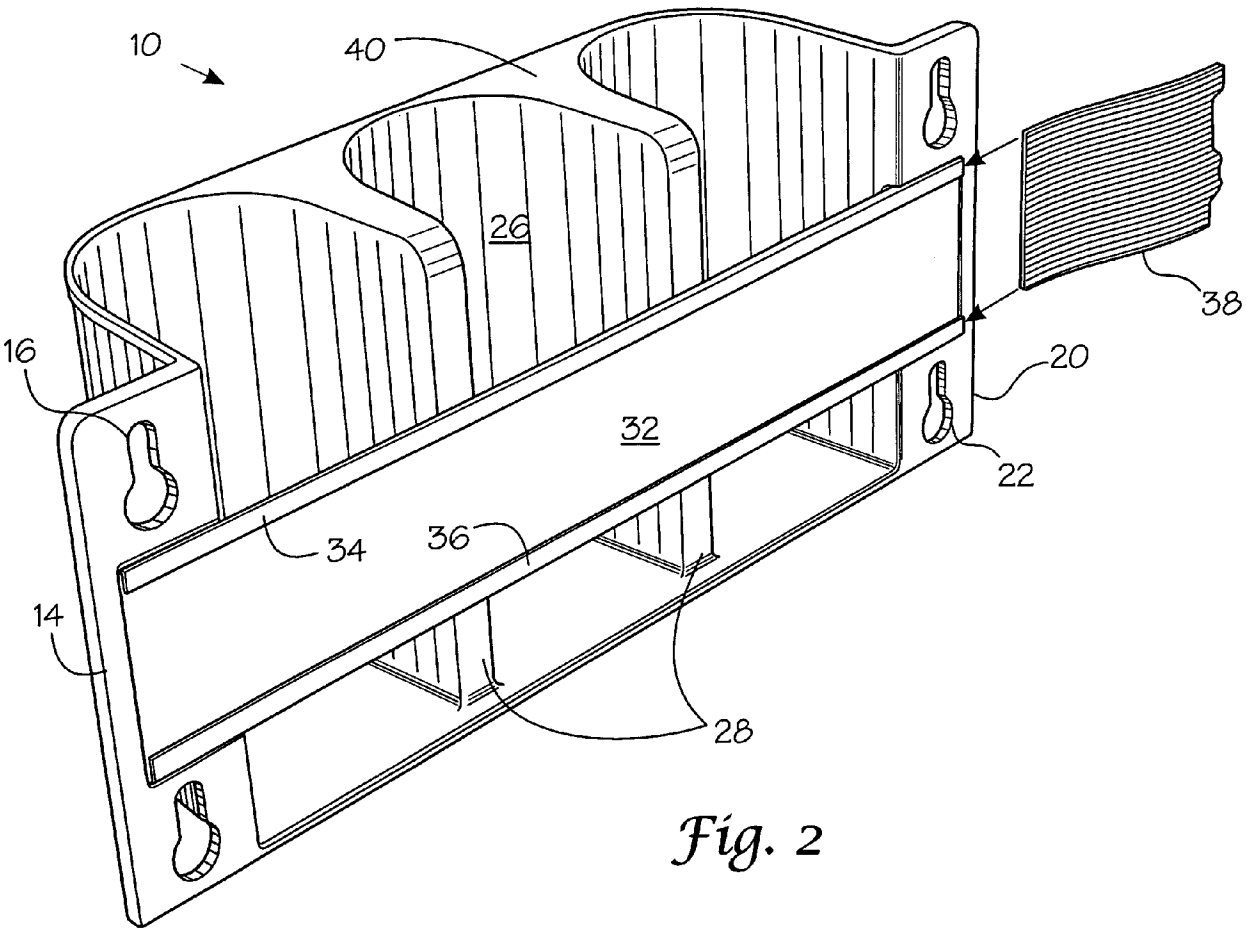
FIG. 2 is a front perspective view of the shelf device of FIG. 1 with a display panel attached.
Figure 3:
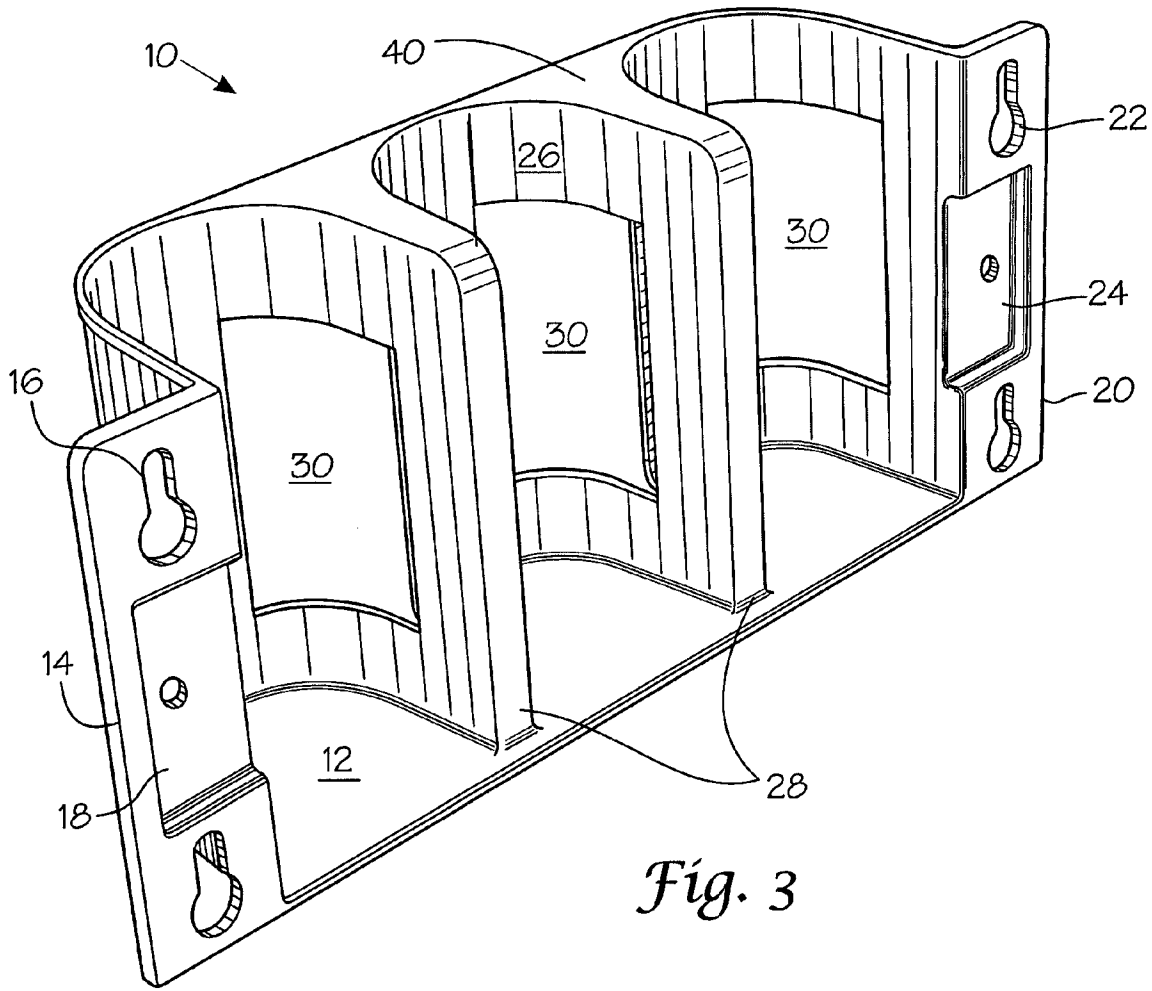
FIG. 3 is a front perspective view of a shelf device similar to FIG. 1 but having ventilation windows.

Referring to FIGS. 1-3, a shelf device 10 is provided for attaching to an inside surface of an upright cooler door. Articles, such as beverage containers for example, can be placed on shelf device 10 for easy viewing through the cooler door which minimizes the need to open the door to view the contents. It also utilizes the door space for storing additional product in a space that may otherwise be wasted. Product on the shelf device always remains up front within the easy grasp of a consumer.

Shelf device 10 has a bottom panel 12 with front, rear, left and right side edge portions. A left mounting flange 14 is connected to bottom panel 12 along the front and left side edge portions and extends upward therefrom. Left mounting flange 14 has a pair of slotted openings or keyways 16 therein vertically spaced from one another and adapted to mount and support the shelf device in conjunction with suction cups or the like. Left flange 14 has a slot or recess 18 preferably positioned between the keyways 16.

Similarly, a right mounting flange 20 is connected to bottom panel 12 along the front and right side edge portions and extends upward therefrom. Right mounting flange 20 has a pair of keyways 22 therein vertically spaced from one another and adapted to mount and support the shelf device in conjunction with suction cups. Right flange 20 has a slot or recess 24 preferably positioned between the keyways 22. Preferably, the front faces of the mounting flanges are flush with the front edge of bottom panel 12. The recesses 18, 24 of mounting flanges 14, 20 may contain bores for accepting screws or other fasteners.

A partition panel 26 is connected to bottom panel 12 and the left and right mounting flanges 14, 20 dividing bottom panel 12 into a plurality of compartments. Panel 26 extends upward from bottom panel 12. As illustrated, the compartments are curved to fit the contour of beverage bottles, but can be contoured to fit other container shapes. A bridging member 40 spans the spaces at the top between the outside curves of the compartments. Also, where desired, bottom panel 12 can extend between similar spaces at the bottom of the outside curves of the compartments.

A supporting rib 28 is formed at the junction of adjacent segments of partition panel 26. Ribs 28 are recessed from the front edge of bottom panel 12. The resulting space improves air circulation. Air flow is further improved by providing each compartment or selected compartments with a ventilation opening or window 30. Window 30 may be positioned at any location in a compartment along partition panel 26, but cross ventilation is encouraged when windows in adjacent compartments face one another. A single compartment may have more than one window and, similarly, each compartment need not have a window at all depending upon the particular environment.

A display panel 32 is attached to the left and right mounting flanges 14, 20 in their respective recesses 18, 24. Display panel 32 is spaced from bottom panel 12 and is not required to contribute to the support of the shelf device 10. The spacing improves air circulation. Top and bottom flanges or lips 34, 36 form a slot for slidably receiving a display insert 38. Each lip may be a long, single lip or may be a series of shorter lips extending across display panel 32. Because display panel 32 is seated in flange recesses 18, 24, it can be flush with the front edge of bottom panel 12 and the front faces of flanges 14, 20. It is preferred that the slot formed by flanges 34, 36 extend above the flanges an amount sufficient for installing and removing display insert 38.

Still referring to FIGS. 1-3, the shelf device is preferably constructed of plastic. Bottom panel 12, flanges 14, 20 and partition panel 26 can be injection molded as a single unit with display panel 32 injection molded as a separate unit. Panel 32 can be attached with screws fitting through the bores in the flanges, but it is preferred to mold it with protrusions known as tree fasteners. Tree fasteners allow the display panel to be quickly and easily installed without tools. A plastic display insert can slide into and be slidably removed from the slot in the display panel.

Figure 4:
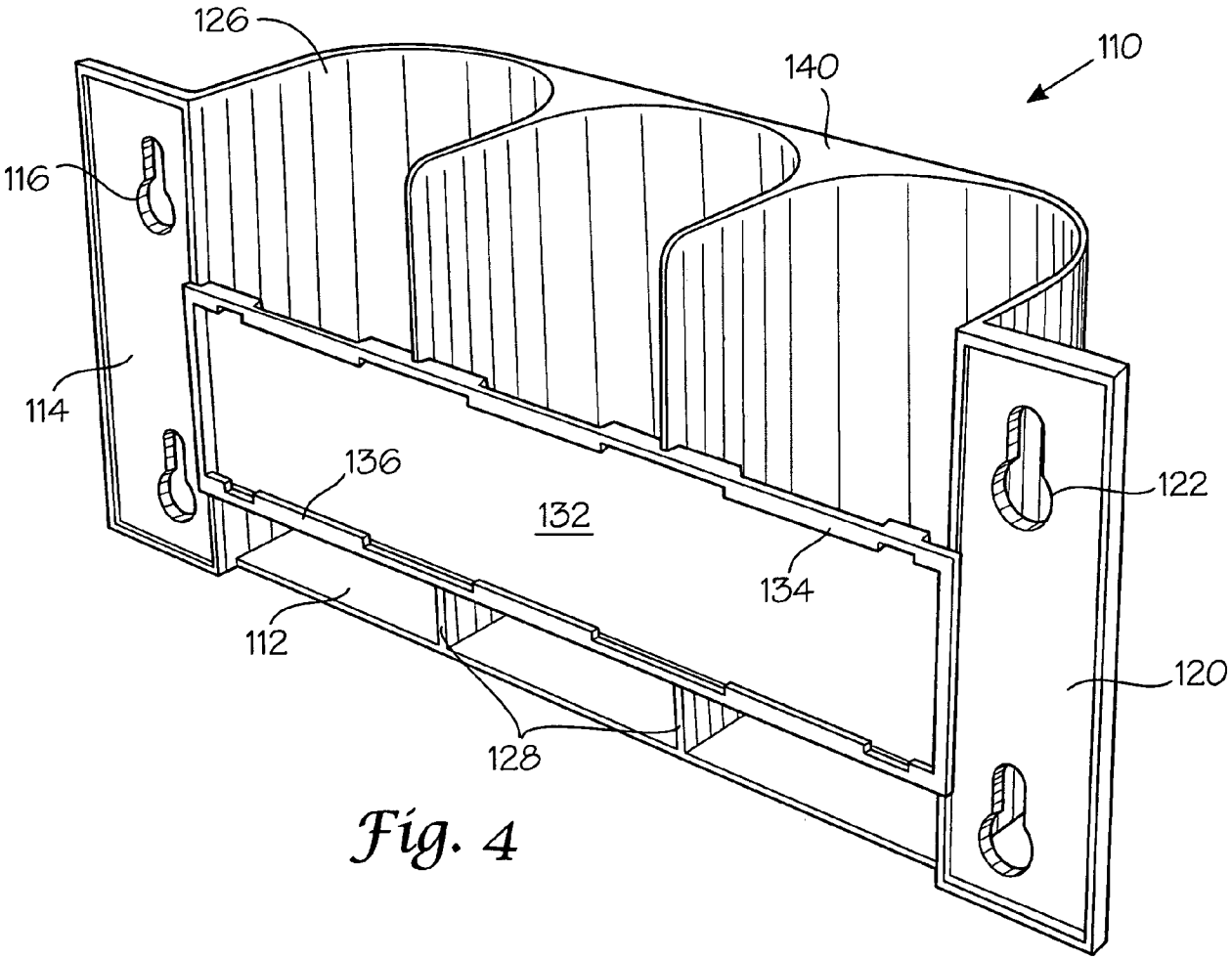
FIG. 4 is a front perspective view of another preferred embodiment of a shelf device for attaching to the inside surface of an upright cooler door according to the present invention featuring a display panel attached to support ribs.
Figure 5:
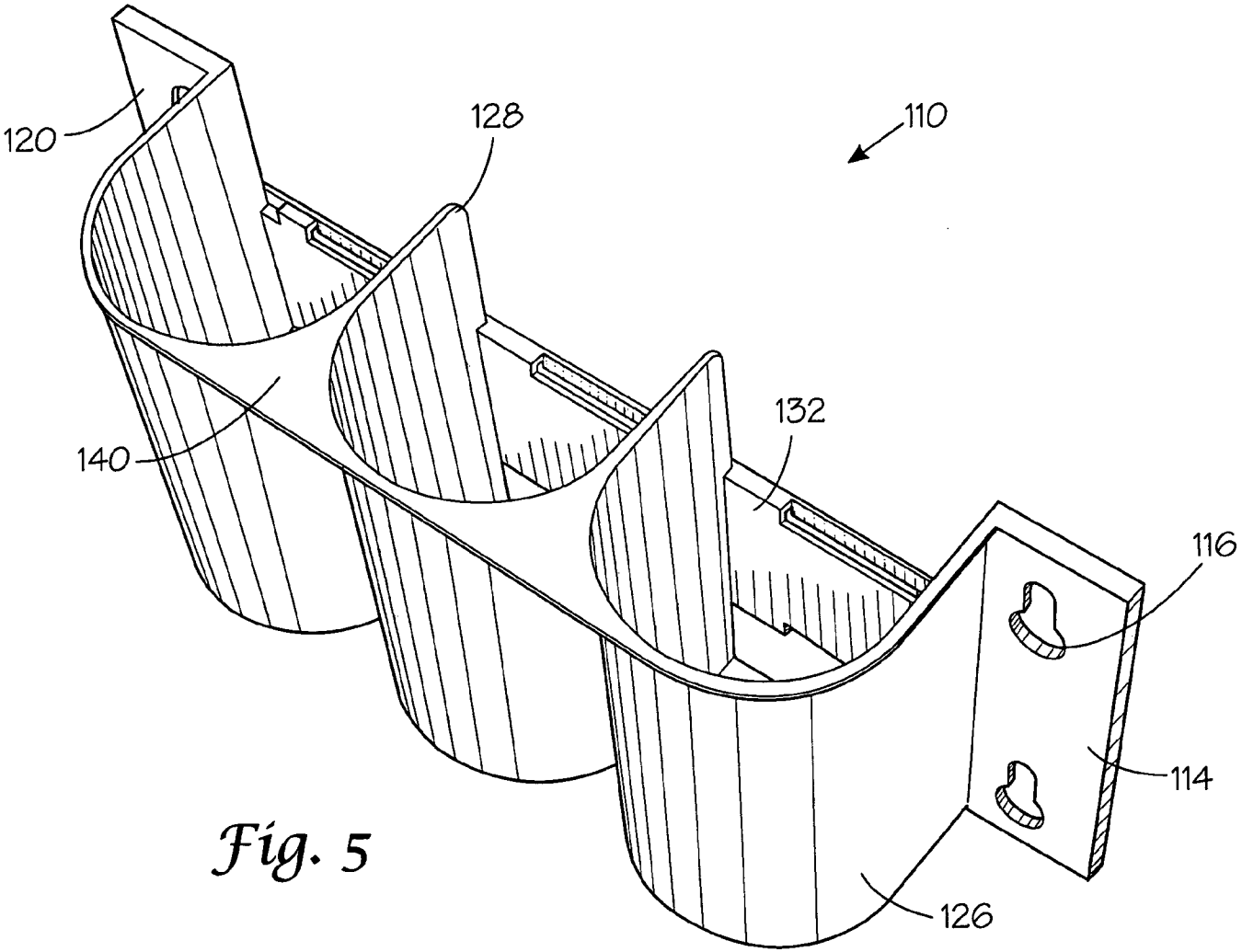
FIG. 5 is a top rear view of the shelf device of FIG. 4.

Referring now to FIGS. 4-5, shelf device 110 has a bottom panel 112 with front, rear, left and right side edge portions. A left mounting flange 114 has a pair of keyways 116 therein vertically spaced from one another and adapted to mount and support the shelf device in conjunction with suction cups or the like. A right mounting flange 120 has a pair of keyways 122 therein vertically spaced from one another and adapted to mount and support the shelf device in conjunction with suction cups.

A partition panel 126 is connected to bottom panel 112 and the left and right mounting flanges 114, 120 dividing bottom panel 112 into a plurality of compartments. Panel 126 extends upward from bottom panel 112. The front edge of bottom panel 112 is recessed from the left and right ends of partition panel 126. As illustrated, the compartments are curved to fit the contour of beverage bottles, but can be contoured to fit other container configurations. A bridging member 140 spans spaces at the top between the outside curves of the compartments.

A mounting rib 128 having a vertical slot is formed at the junction of adjacent segments of partition panel 126. Ribs 128 are preferably flush with the front edge of bottom panel 112. Left and Right flanges 114, 120 are attached to the left and right ends of partition panel 126 and thus extend forward of bottom panel 112. The resulting space improves air circulation across the front of the shelf device. Air flow is further improved by providing the compartments with ventilation openings or windows (not shown).

A display panel 132 is attached to the mounting ribs 128 in the slots. Display panel 132 is spaced from bottom panel 112 and is not required for the support of the shelf device 110. The spacing improves air circulation. Top and bottom flanges or lips 134, 136 form a slot for slidably receiving a display insert. Each lip may be a long, single lip or may be a series of shorter lips extending across display panel 132. A series of shorter lips is preferred to improve flexibility so that the panel can be force fit into the slots in the ribs. In addition to lips facing to the front, there may be lips facing the rear for fitting into the slots. To increase integrity of the construction, display panel 132 may have end portions lapping onto left and right flanges 114, 120 and wedged with a rear facing lip, or attached with an adhesive or the like. Because display panel 132 is seated in the mounting rib slots, it is not flush with the front edge of bottom panel 112 but extends forward thereof. It is preferred that the slot formed by lips 134, 136 extend above the flanges an amount sufficient for installing and removing a display insert.

Still referring to FIGS. 4-5, shelf device 110 differs from shelf device 10 in the positioning of the partition panel on the bottom panel, and in the left and right mounting flanges. Shelf device 10 has ribs of partition panel 26 set back from the front edge of bottom panel 12, and flanges 14, 20 have recesses also so that display panel 32 seats in the recesses and rests in front of ribs 28. On the other hand, shelf device 110 has ribs 128 of partition panel 126 flush with the front edge of bottom panel 112, and left and right flanges 114, 120 do not have full recesses. There is a partial recess at the corner where the flanges and partition panel meet. This partial recess is sufficient for a force fit of the lips of the display panel to keep ends of the display panel from being unseated and curling. Ribs 128 have slots for seating display panel 132 which can rest in front of flanges 114, 120. Display panel 132 can be force fit while display panel 32 attaches with an adhesive or fasteners.

Figure 6:
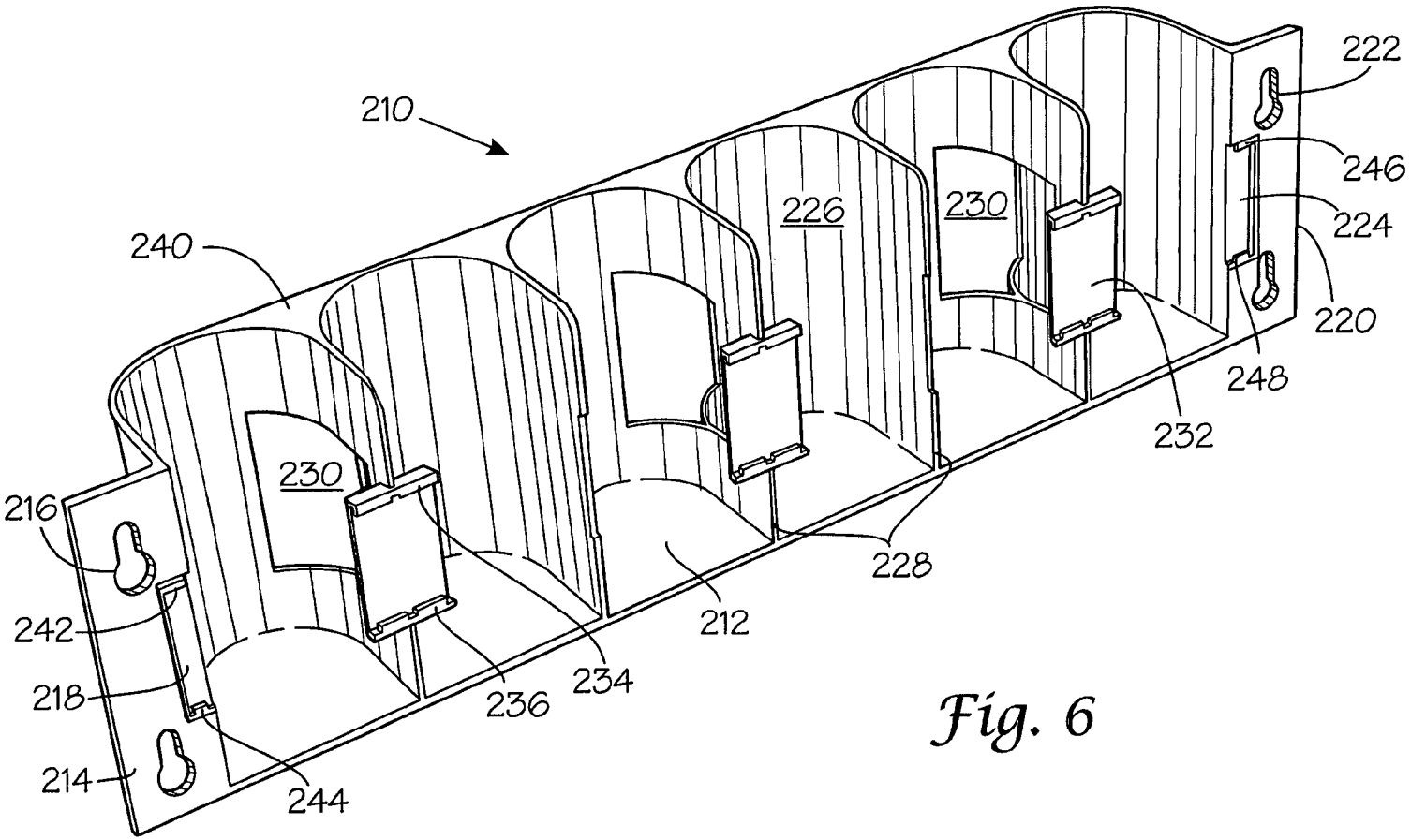
FIG. 6 is a front perspective view of another preferred embodiment of a shelf device for attaching to the inside surface of an upright cooler door according to the present invention featuring segmented display panels attached to support ribs.
Figure 7:
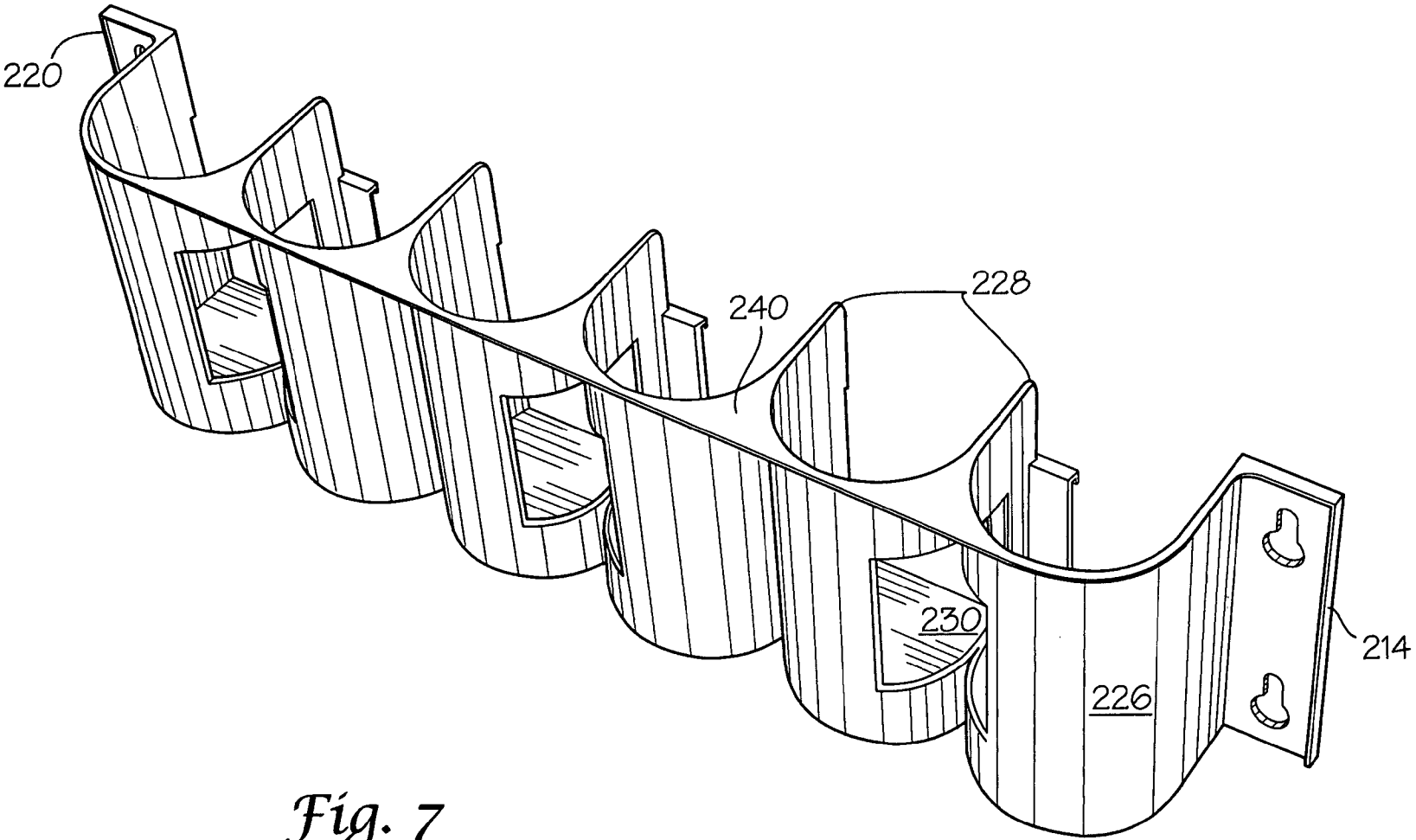
FIG. 7 is a rear perspective view of the shelf device of FIG. 6.
Figure 8:
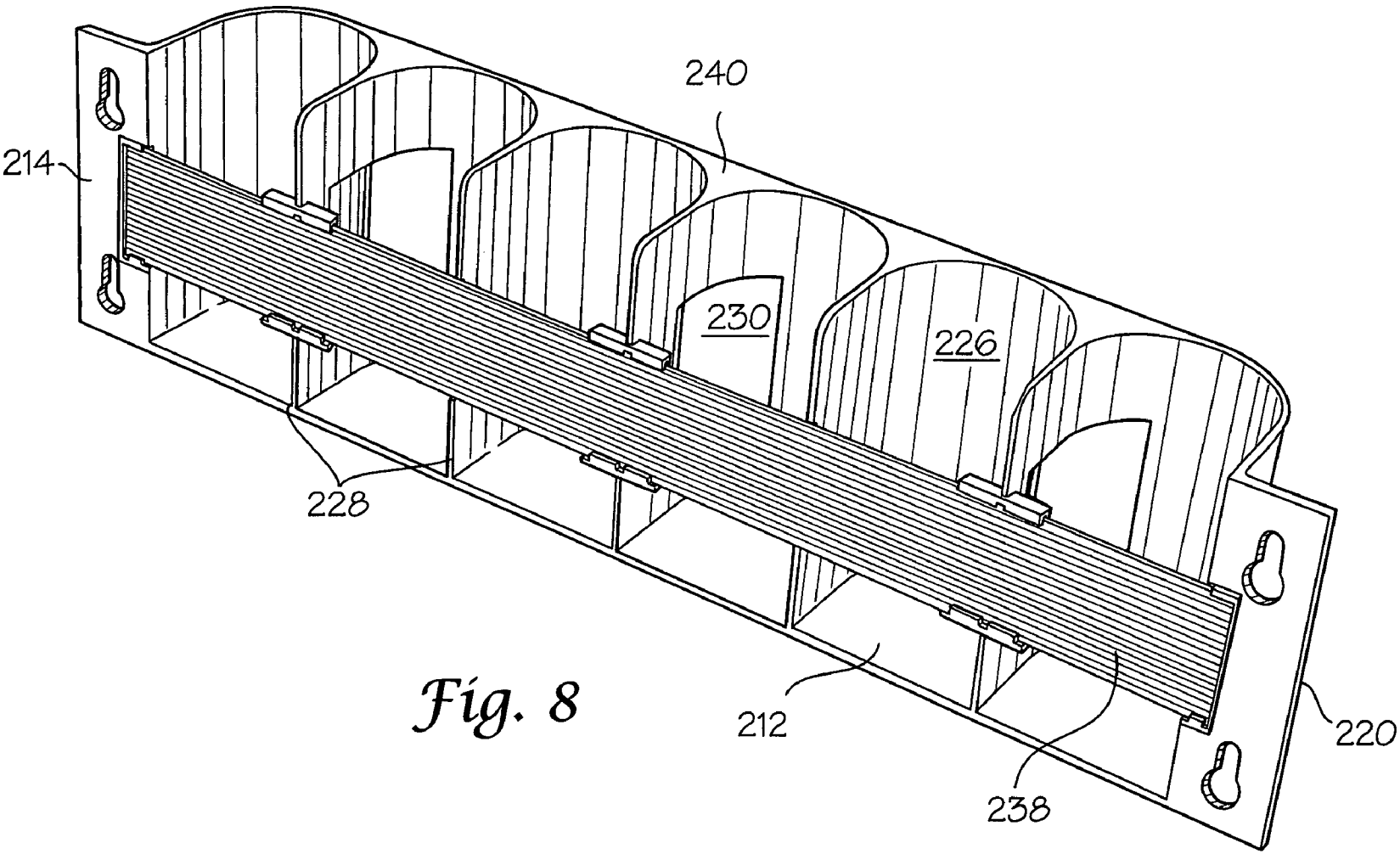
FIG. 8 is a front perspective view of the shelf device of FIG. 6 with a display panel attached.

Referring to FIGS. 6-8, shelf device 210 has a bottom panel 212 with front, rear, left and right side edge portions. A left mounting flange 214 is connected to bottom panel 212 along the front and left side edge portions thereof and extends upward therefrom. Left mounting flange 214 has a pair of slotted openings or keyways 216 therein vertically spaced from one another and adapted to mount and support the shelf device in conjunction with suction cups or the like. Left flange 214 has a slot or recess 218 preferably positioned between the keyways 216.

Similarly, a right mounting flange 220 is connected to bottom panel 212 along the front and right side edge portions thereof and extends upward therefrom. Right mounting flange 220 has a pair of keyways 222 therein vertically spaced from one another and adapted to mount and support the shelf device in conjunction with suction cups. Right flange 220 has a slot or recess 224 preferably positioned between the keyways 222. Preferably, the front faces of the mounting flanges are flush with the front edge of bottom panel 214.

A partition panel 226 is connected to bottom panel 212 and the left and right mounting flanges 214, 220 dividing bottom panel 212 into a plurality of compartments. Panel 226 extends upward from bottom panel 212. The front edge of bottom panel 212 is flush with the left and right ends of partition panel 226 flush with front faces of left and right flanges 214, 220. As illustrated, the compartments are curved to fit the contour of beverage bottles, but can be contoured to fit other container configurations. A bridging member 240 spans spaces at the top between the outside curves of the compartments giving a more finished appearance and increasing structural integrity. Also, where desired, bottom panel 212 can extend between similar spaces at the bottom of the outside curves of the compartments. Air flow is improved by providing each compartment or selected compartments with a ventilation opening or window 230. Window 230 may be positioned at any location in a compartment along partition panel 226, but cross ventilation is encouraged when windows in adjacent compartments face one another.

A display panel 232 is attached to selected ribs 228. Display panel 232 is spaced from bottom panel 212 and is not required to contribute to the support of the shelf device 210. The spacing improves air circulation. Top and bottom flanges or lips 234, 236 in each display panel 232 form slots for slidably receiving a display insert 238. Because display insert 238 is seated in flange recesses 218, 224, it can be flush with the front edge of bottom panel 212 and the front faces of flanges 214, 220. To help keep display insert 238 seated, left flange 214 has upper and lower protrusions 242, 244 to retain the left end of display insert 238, while right flange 220 has upper and lower protrusions 246, 248 to retain the right end of display insert 238. The protrusions form pockets for holding the ends of the display panel.

A mounting rib 228 having a vertical slot is formed at the junction of adjacent segments of partition panel 224. Ribs 228 are flush with the front edge of bottom panel 212. Left and right flanges 214, 220 are attached to the left and right ends of partition panel 226. The vertical slots containing individual display panels differs from the arrangement of display panels in shelf devices 10 and 110.

Figure 9:
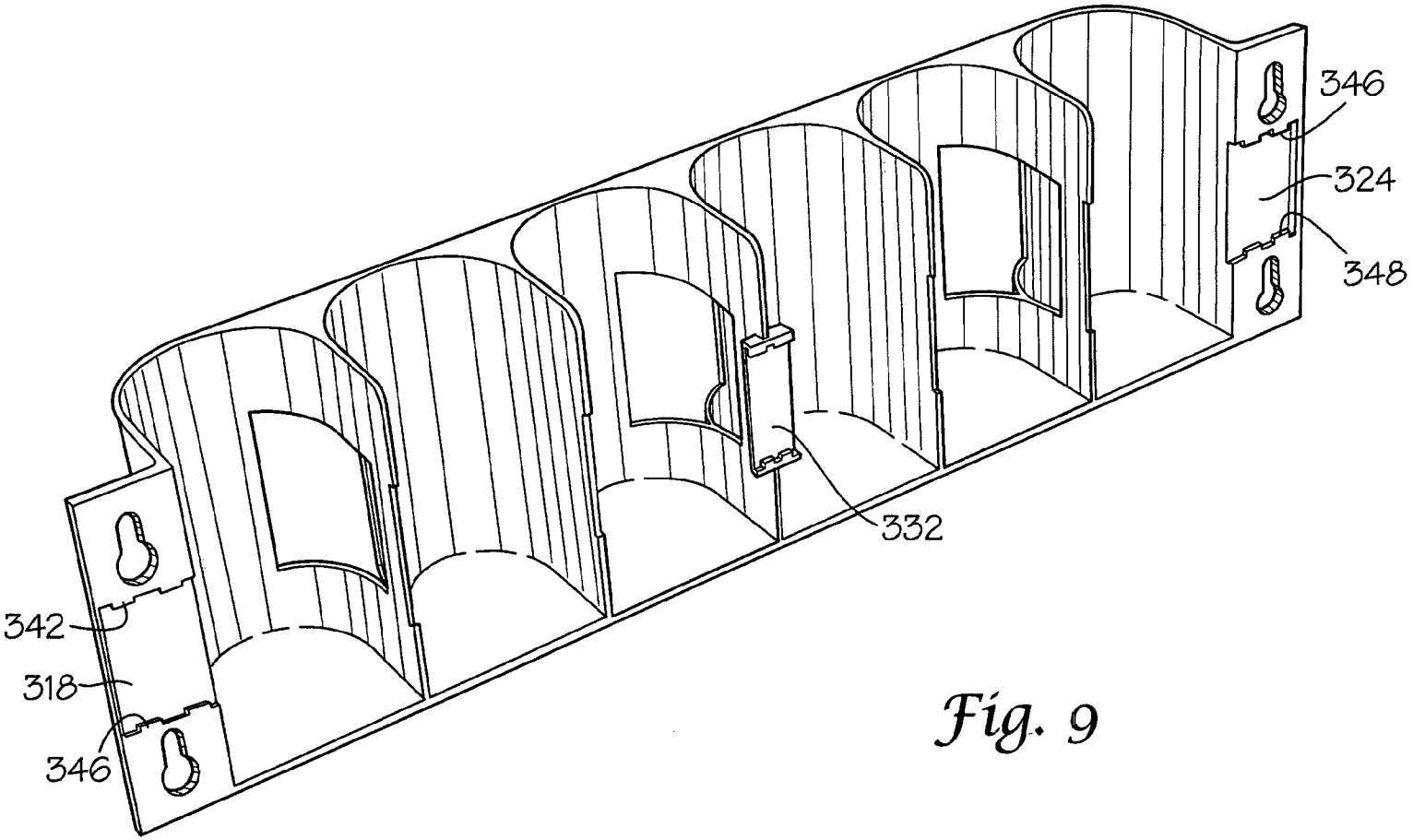
FIG. 9 is a front perspective view similar to FIG. 6 but illustrating another preferred embodiment.

Referring now to FIGS. 6 and 9, there are two arrangements of display panel and mounting flange recesses illustrated. In FIG. 6, display panels 232 are wide and flange recesses 218, 224 narrow. Preferably, each display panel 232 has about twice the width of each recess 218, 224. On the other hand, FIG. 9 shows each flange recess 318, 324 having about twice the width of each display panel 332. Where the wider flange recesses 318, 324 are used, it has been determined that fewer display panels 332 are required for the desired inset holding and presentation ability. FIG. 9 shows left upper and lower flange protrusions 342, 344 as multiple protrusions instead of a single protrusion. Similarly, right upper and lower protrusions 346, 348 are multiple instead of single protrusions.

While the invention has been described with particular reference to the preferred embodiments, it will be understood by those skilled in the art that various changes may be made and equivalents may be substituted for elements of the preferred embodiments without departing from invention. For example, display devices with three and six compartments have been illustrated but any number of compartments can be formed. Also, while a display panel and a separate display insert have been described, a display insert may sometimes be used alone without a separate display panel. It is accordingly intended that the claims shall cover all such modifications and applications as do not depart from the true spirit and scope of the invention.

ELEMENT LIST

10 shelf device
12 bottom panel
14 left mounting flange
16 left keyways
18 left flange recess
20 right mounting flange
22 right keyways
24 right flange recess
26 partition panel
28 supporting ribs
30 ventilation window
32 display panel
34 top flange or lip
36 bottom flange or lip
38 display insert
40 bridging member
110 shelf device
112 bottom panel
114 left mounting flange
116 left keyways
120 right mounting flange
122 right keyways
126 partition panel
128 mounting rib
132 display panel
134 top flange or lip
136 bottom flange or lip
140 bridging member
210 shelf device
212 bottom panel
214 left mounting flange
216 left keyways
218 left recess
220 right mounting flange
222 right keyways
224 right recess
226 partition panel
228 mounting rib
230 ventilation window
232 display panel
234 top lip
236 bottom lip
238 display insert
240 bridging member
242 upper protrusion
244 lower protrusion
246 upper protrusion
248 lower protrusion
318 left flange recess
324 right flange recess
332 display panel
342 upper left flange protrusion
344 lower left flange protrusion
346 upper right flange protrusion
348 lower right flange protrusion

What is claimed is:

1. A shelf device for an inside surface of a cooler door, comprising:

a bottom panel having front, rear, left and right side edge portions;

a partition panel connected to said front, rear, left and right side edge portions of said bottom panel and extending upward therefrom, said partition panel dividing said bottom panel and forming a plurality of curved compartments, said partition panel having a left end adjacent said left side edge portion of said bottom panel extending forward of said bottom panel creating an air space therebetween, said partition panel having a right end adjacent said right side edge portion of said bottom panel extending forward of said bottom panel creating an air space therebetween;

a left mounting flange connected to said left end of said partition panel, said left mounting flange having a pair of left keyways therein vertically spaced from one another and adapted to mount and support said shelf device;

a right mounting flange connected to said right end of said partition panel, said right mounting flange having a pair of right keyways therein vertically spaced from one another and adapted to mount and support said shelf device;

a plurality of vertical ribs attached to said partition panel at junctions of adjacent curved compartments, each rib of said plurality of ribs having a slot and being flush with said front edge portion of said bottom panel; and a display panel mounted in said slots in said ribs, spaced from said bottom panel and extending laterally between said left and right flanges.

2. A shelf device, as set forth in claim 1, wherein said display panel includes top and bottom lips forming a slot for receiving a display insert.

3. A shelf device, as set forth in claim 1, wherein said partition panel defines at least one opening in each of said compartments.

4. A shelf device, as set forth in claim 1, wherein said display panel is attached to said left and right mounting flanges.

5. A shelf device, as set forth in claim 1, wherein said display panel has end portions lapping onto said left and right flanges.

* * * * *